US006419081B1

(12) United States Patent
Ross

(10) Patent No.: US 6,419,081 B1
(45) Date of Patent: Jul. 16, 2002

(54) COMBINED PILL AND WATER CONTAINER

(76) Inventor: Edward N. Ross, 7579 SE. Fiddlewood La., Hobe Sound, FL (US) 33455

( * ) Notice: Subject to any disclaimer, the term of this patent is extended or adjusted under 35 U.S.C. 154(b) by 0 days.

(21) Appl. No.: 09/563,363

(22) Filed: May 3, 2000

(51) Int. Cl.[7] ..... B65D 83/04
(52) U.S. Cl. ..... 206/217; 206/538; 206/540
(58) Field of Search ..... 206/217, 218, 206/528–540, 216, 570; 215/6; 220/375; 224/269, 230

(56) References Cited

U.S. PATENT DOCUMENTS

| | | | | | |
|---|---|---|---|---|---|
| 378,752 | A | * | 2/1888 | Ader | 215/6 |
| 2,766,796 | A | * | 10/1956 | Tupper | 206/217 |
| 3,514,008 | A | | 5/1970 | Dorn | |
| 3,920,120 | A | | 11/1975 | Shveda | |
| 3,926,361 | A | | 12/1975 | Hilderbrand | |
| 4,051,977 | A | * | 10/1977 | Steinfield | 206/217 |
| 4,171,753 | A | * | 10/1979 | Vreede | 206/536 |
| 4,324,338 | A | * | 4/1982 | Beall | 206/217 |
| 4,387,804 | A | | 6/1983 | Austin | |
| 4,416,370 | A | | 11/1983 | Beall | |
| 4,955,572 | A | * | 9/1990 | Simmons | 248/683 |
| 5,076,433 | A | | 12/1991 | Howes | |
| 5,397,017 | A | * | 3/1995 | Muza et al. | 206/538 |
| 5,667,094 | A | * | 9/1997 | Rapchak et al. | 220/375 |
| 5,765,716 | A | * | 6/1998 | Cai et al. | 220/375 |
| 6,149,939 | A | * | 11/2000 | Strumor | 424/464 |

* cited by examiner

*Primary Examiner*—Jim Foster
(74) *Attorney, Agent, or Firm*—Siemens Patent Services, L.C.

(57) ABSTRACT

A combined pill and water container comprising a cylindrical housing. A structure is for holding a plurality of pills and a supply of water separately within the cylindrical housing, so that a person carrying the cylindrical housing can take their pills with water any time.

5 Claims, 3 Drawing Sheets

COMBINED PILL AND WATER CONTAINER

BACKGROUND OF THE INVENTION

1. Field of the Invention

The present invention relates generally to containers. More particularly, the invention comprises a combined pill and water container.

In general, a first field of use of the disclosed invention is by manufacturers of medicine tablets as the most likely benefactors of the unique advantages of the instant invention. However, many other fields, such as manufacturers of camping equipment, food, etc., could find potentially beneficial uses of this invention.

Thus, it can be seen that the potential fields of use for this invention are myriad and the particular preferred embodiments described herein is in no way meant to limit the use of the invention to the particular field chosen for exposition of the details of the invention.

A comprehensive listing of all the possible fields to which this invention may be applied is limited only by the imagination and is, therefore, not provided herein. Some of the more obvious applications are mentioned in the interest of providing a full and complete disclosure of the unique properties of this previously unknown general purpose article of manufacture. It is to be understood from the outset that the scope of this invention is not limited to these fields or to the specific examples of potential uses presented herein.

2. Description of the Prior Art

Attempts have been made in the prior art to devise containers for holding two different separate products.

Various types of containers are shown in U.S. Pat. No. 3,514,008, issued to Philip K. Dorn on May 26, 1970, U.S. Pat. No. 3,920,120, issued to Andrew P. Shveda on Nov. 18, 1975, U.S. Pat. No. 3,926,361, issued to Henry R. Hilderbrand on Dec. 16, 1975, U.S. Pat. No. 4,387,804, issued to John J. Austin on Jun. 14, 1983, U.S. Pat. No. 4,416,370, issued to Robert Beall on Nov. 22, 1983 and U.S. Pat. No. 5,076,433, issued to James P. Howes on Dec. 31, 1991.

U.S. Pat. No. 3,514,008 to Dorn discloses a combination pill container and drinking cup. An outer sleeve is mounted on the pill container and is axially slidable from a retracted storage position to an extended position when the pill container is inverted. The sleeve serves as a drinking cup in the extended position.

U.S. Pat No. 3,920,120 to Shveda discloses a combination package. The combination package is for a primary product and a secondary product complementary to the primary product. The secondary product is restrained in the secondary product containment volume.

U.S. Pat. No. 3,926,361 to Hilderbrand discloses a disposable container with napkin holder. A handle member affixed to the outside of the container is movable from a position juxtaposed with the container to a position extending radially from the container and is utilized as a handle. A napkin holder affixed to the outside of the container spaced from the handle member releasably supports a napkin.

U.S. Pat. No. 4,387,804 to Austin discloses a convertible pill cup package. The package is for containing a preselected quantity of product such as a pill, which may be easily and quickly converted for use as a drinking cup. A portion of the package enclosing the product may be removed from the remaining part of the package which defines the cup.

U.S. Pat. No. 4,416,370 to Beall discloses a compartmented container. The compartmented container is capable of being used to efficiently and expeditiously dispense both a liquid and a non-liquid substance therefrom. It is easy to handle so that it reduces the overall time required for dispensing the substances therefrom.

U.S. Pat. No. 5,076,433 to Howes discloses a prize delivery system. It consists of a container, holder or instrument for use with food products. It is identical in all respects to typical product containers, holders or instruments, but which secretly contains a hidden prize award.

The present invention is completely different than these patents in that it consists of a combined pill and water container. It is a device which holds pills and water in their own removably sealed compartmentalized sections. There is also a clip on the device so it can easily be carried in a pocket.

None of the above inventions and patents, taken either singly or in combination, is seen to describe the instant invention as claimed.

SUMMARY OF THE INVENTION

The present invention is a combined pill and water container that consists of a device which holds pills and water in their own removably sealed compartmentalized sections.

Accordingly, it is a principal object of the invention to provide a combined pill and water container that will overcome the shortcomings of the prior art devices.

Another object of the invention is to provide a combined pill and water container that consists of a cylindrical housing having removable sealed end caps for access into a pill compartment and a water compartment, so that a person can take their pills with water any time.

An additional object of the invention is to provide a combined pill and water container wherein a pill container is retained in a removably sealed condition inside an upper portion of a water container.

A further object of the invention is to provide a combined pill and water container that is simple and easy to use.

A still further object of the invention is to provide a combined pill and water container that is economical to manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
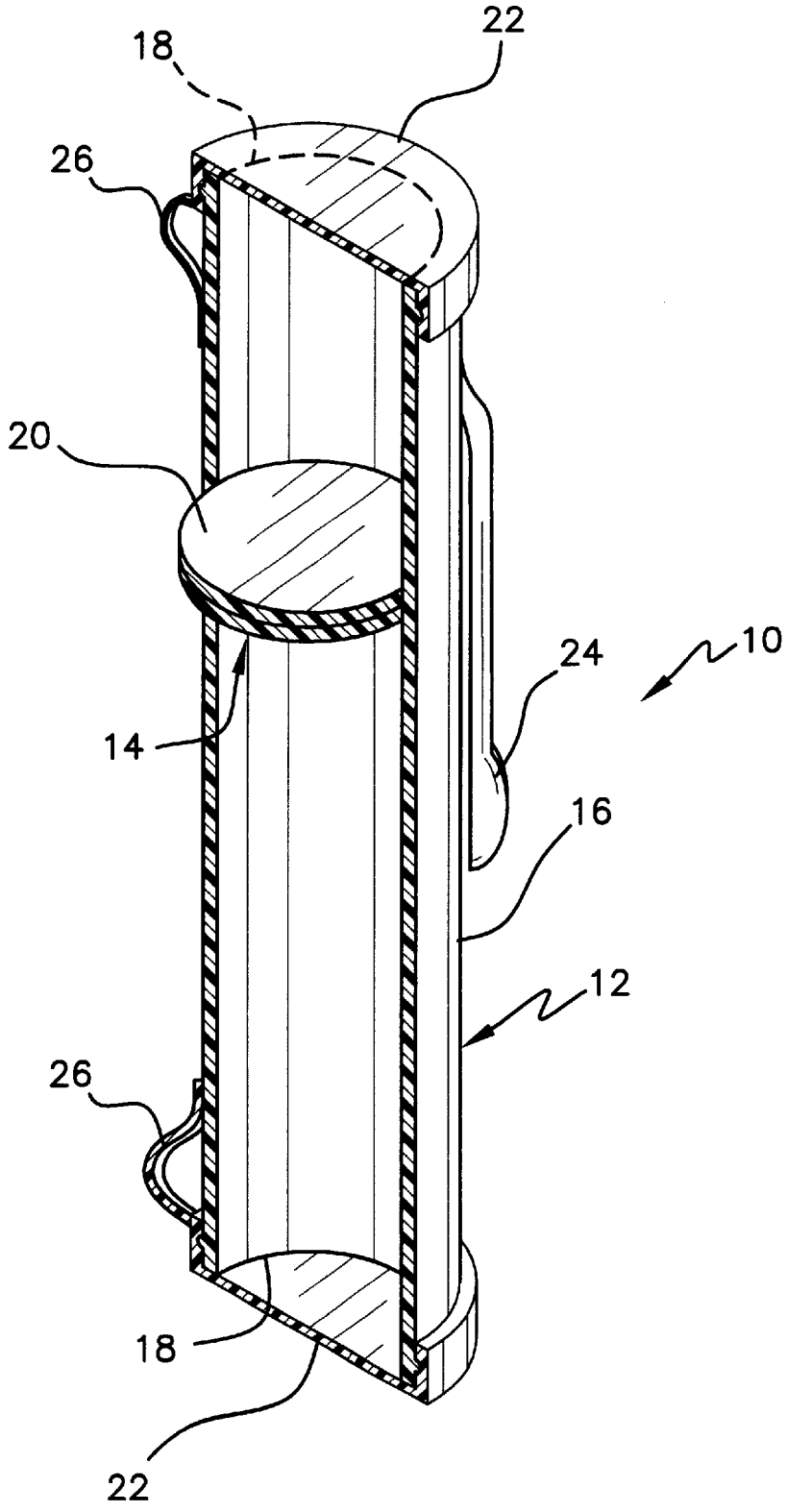
FIG. 1 is a diagrammatic cross sectional view of a first embodiment of the present invention.
Figure 2:
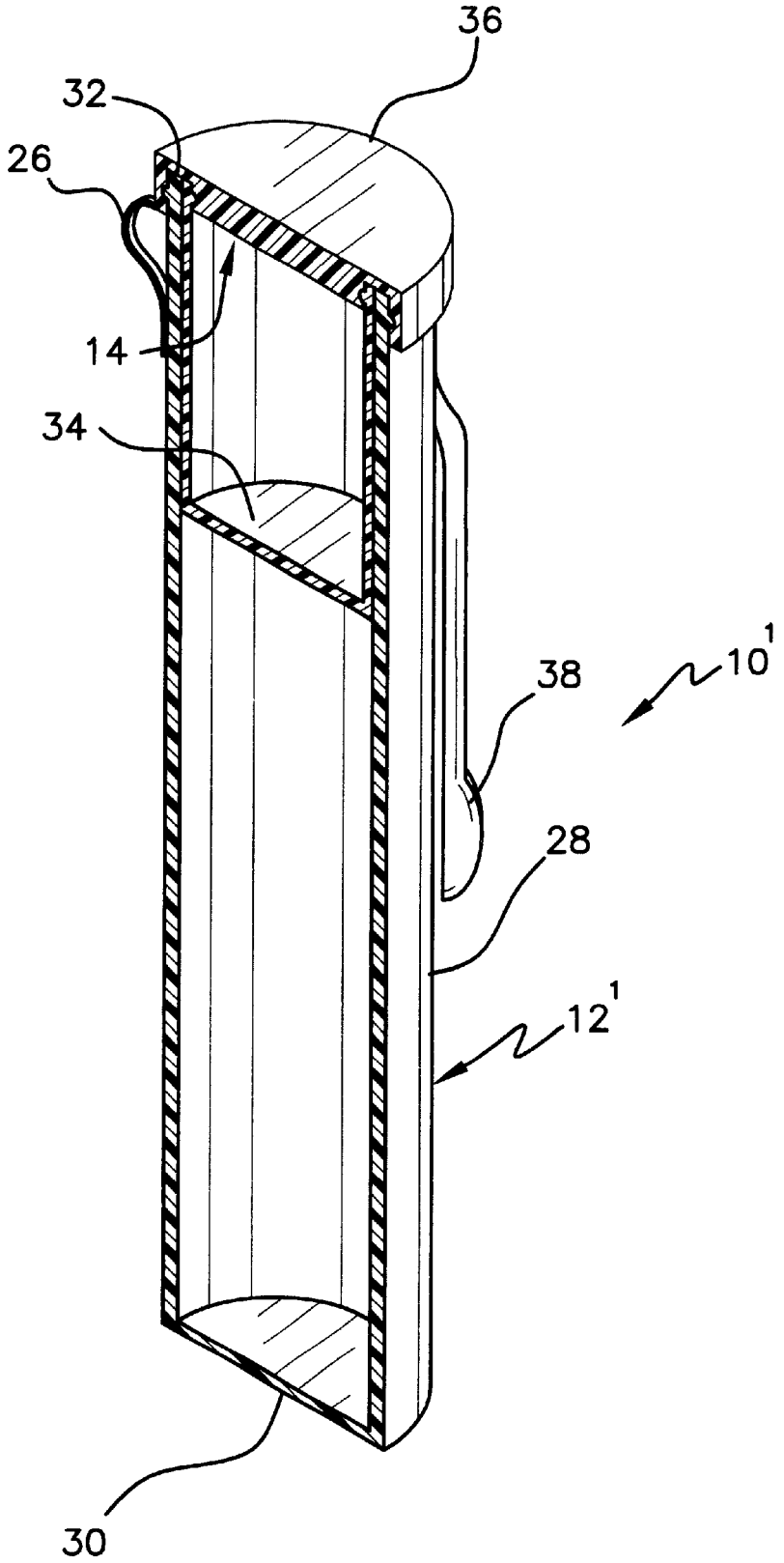
FIG. 2 is a diagrammatic cross sectional view of a second embodiment of the present invention.
Figure 3:
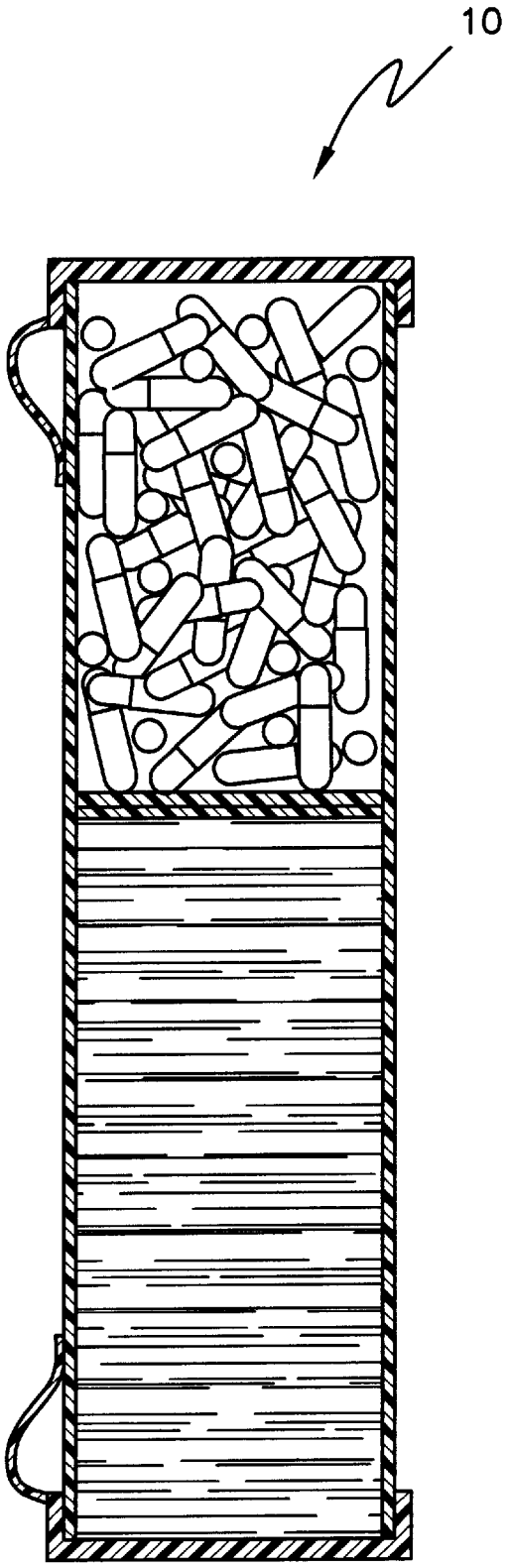
FIG. 3 is a view of FIG. 1 in use with pills and water.

Turning now descriptively to the drawings, in which similar reference characters denote similar elements throughout the several views, FIGS. 1 and 2 illustrate the various components of the present invention being a combined pill and water container 10 comprising a cylindrical housing 12. A structure 14 is for holding a plurality of pills and a supply of water separately within cylindrical housing 12, so that a person carrying cylindrical housing 12 can take their pills with water any time.

Cylindrical housing 12 in FIG. 1 is an elongated vial 16 having opposite open ends 18. Holding structure 14 includes an internal compartment separator 20 within elongated vial 16. A pair of end caps 22 seal open ends 18 of elongated vial 16.

Elongated vial 16 contains a clip 24, so that it can be easily carried in a pocket. End cap attachments 26, are provided so that end caps 22 cannot be lost therefrom. End caps 22 can be screw-on types, snap-on types, or cork plug-in types.

Cylindrical housing 12 in FIG. 2 is a tubular container 28 having a closed end 30 and an open end 32, for storing the water therein. Holding structure 14 includes a second smaller tubular container 34 for storing the pills therein and is sized to fit into open end 32 of first tubular container 28. A removable cap 36 on second smaller tubular container 34 seals open end 32 of first tubular container 28 when second smaller tubular container 34 is inserted therein. First tubular container 28 contains a clip 38, so that it can be easily carried in a pocket.

To use combined pill and water container 10 in FIG. 1, a person simply fills one side of elongated vial 16 with pills and other side with water. End caps 22 now seal open ends 18 of the elongated vial 16. Clip 24 will allow elongated vial 16 to be carried in a pocket.

When the person wants to take the pills, end cap 22 on first open end 18 of elongated vial 16 is removed to allow pills to be extracted therefrom. End cap 22 on second open end 18 of elongated vial 16 with water is then removed when in a vertical position to allow water to be consumed therefrom, so that the person can swallow the pills.

To use combined pill and water container 10 in FIG. 2, a person simply fills first tubular container 28 with water and second smaller tubular container 34 with pills. Second smaller tubular container 34 is inserted into open end 32 of first tubular container 28. Removable cap 36 seals open end 32 of first tubular container 28. Clip 38 will allow first tubular container 28 to be carried in a pocket.

When the person wants to take the pills, removable cap 36 is removed from open end 32. Second smaller tubular container 34 is taken out to allow pills to be extracted therefrom. Water can be consumed from first tubular container 28, so that the person can swallow the pills.

In an alternate embodiment(not shown) the cylindrical housing 12 may be constructed of two pieces which would allow the cylindrical housing 12 to be separated at the compartment separator 20 by a screw thread or other acceptable means.

It is to be understood that the present invention is not limited to the embodiments described above, but encompasses any and all embodiments within the scope of the following claims.

I claim:

1. A container for separately housing two disparate items, comprising:

a) a first cylinder having an open top, a predetermined height, and a closed bottom;

b) a second cylinder adapted for slidable retention within said first cylinder, said second cylinder having an open top, a second predetermined height smaller than said first predetermined height, and a closed bottom;

c) pills disposed in one of said first and said second cylinders and liquid disposed in the other of said first and said second cylinders;

d) closure means adapted to seal both said first cylinder and said second cylinder and to isolate the interior volume of said second cylinder from the interior volume of said first cylinder.

2. The container for separately housing two disparate items as recited in claim 1, wherein said closure means comprises a screw cap.

3. The container for separately housing two disparate items as recited in claim 2, wherein said first cylinder comprises an externally threaded portion adjacent said open top of said first cylinder, and said second cylinder comprises an internally threaded portion adjacent said open top of said second cylinder, and wherein said closure means comprises both internal and external threads adapted for interaction with said threaded portions of both said first cylinder and said second cylinder.

4. The container for separately housing two disparate items as recited in claim 1, further comprising:

a clip affixed to said first cylinder and adapted to facilitate retention of said container in a pocket.

5. The container for separately housing two disparate items as recited in claim 1, further comprising:

closure attachment means affixed to said first cylinder and to said closure means for retaining said closure means proximate said first cylinder when said closure means is removed therefrom.

* * * * *